United States Patent [19]

Ito

[11] 4,110,938

[45] Sep. 5, 1978

[54] INFEEDING METHOD FOR INTERNAL GRINDERS

[75] Inventor: Shohei Ito, Narashino, Japan

[73] Assignee: Seiko Seiki Kabushiki Kaisha, Japan

[21] Appl. No.: 734,430

[22] Filed: Oct. 21, 1976

[30] Foreign Application Priority Data

Oct. 31, 1975 [JP] Japan ..... 50-131797

[51] Int. Cl.[2] ..... B24B 1/00

[52] U.S. Cl. ..... 51/281 R; 51/165.88; 51/165.93

[58] Field of Search ..... 51/165 R, 165.71, 165.77, 51/165.87, 165.88, 165.92, 165.93, 281 R

[56] References Cited

U.S. PATENT DOCUMENTS

| | | | |
|---|---|---|---|
| 3,714,741 | 2/1973 | Uhtenwoldt | 51/165.87 |
| 3,736,704 | 6/1973 | Robillard | 51/165.87 |
| 3,952,458 | 4/1976 | Tomita | 51/165.77 |
| 3,964,210 | 6/1976 | Moritomo | 51/165.77 |

*Primary Examiner*—Harold D. Whitehead

*Attorney, Agent, or Firm*—Robert E. Burns; Emmanuel J. Lobato; Bruce L. Adams

[57] ABSTRACT

Infeeding method for internal grinders has rough grinding infeeding and fine grinding infeeding speeds. The changing point from the rough grinding to the fine grinding is shifted earlier in response to the grinding wheel diameter decreasing so that the actual stock-removal rate and the work-up time for a workpiece are kept approximately constant with uniform working on the workpiece.

2 Claims, 3 Drawing Figures

INFEEDING METHOD FOR INTERNAL GRINDERS

BACKGROUND OF THE INVENTION

This invention relates to an internal grinder which successively operates at two or more kinds of predetermined infeed speed in a grinding operation, and more particularly to an internal grinder which selects a changing point from one infeed speed to another in response to the grinding wheel diameter change.

Cutting ability of a grinding wheel is influenced very much by various grinding phenomema and parameters, and particularly by cutting angles of abrasive grains relative to the work surface, i.e. by the wheel diameter. This is well demonstrated in an infeed control method which has a predetermined non-constant infeed vs. time characteristic, as shown by a heavy line $\alpha$ in FIG. 1, and which has a fixed changing point A from rapid infeed (0 to A) to rough grinding infeed (A to B) and a fixed changing point B from the rough grinding infeed to fine grinding infeed (B to C).

When the wheel diameter becomes smaller to some extent, the grinding ability is better so that the actual stock-removal of the workpiece occurs faster as shown by chain line $\beta$ in FIG. 1 to reach the point $t_1$ from which the fine grinding starts and the whole grinding process is finished at the point $f_1$ in a shorter time, with the infeed table returning to $c_1$. On the contrary, a larger wheel diameter tends to be accompanied by poorer grinding ability so that the actual stock removal occurs slower as shown by the two-dotted chain line $\gamma$ in FIG. 1 to reach at the starting point $t_2$ of fine grinding and finish the whole grinding process with at $f_2$, the infeed table returning to $c_2$ in a longer time than that required with a small wheel diameter.

A shorter cycle time of the grinding operation as the former case gives a grinding finish with poor cylindricity and rough surface finish, while a longer cycle time as the latter case requires a longer time than necessary.

SUMMARY OF THE INVENTION

Therefore, it is the principal object of the present invention to provide an infeeding method for internal grinders, with which the above-mentioned fault of the cycle time deviation caused by wheel diameter variation is perfectly eliminated.

This and other objects are attained by a method in which the changing points, from rapid infeed to rough grinding infeed and from rough grinding infeed to fine grinding infeed, are adjusted in response to the wheel diameter, whereby every grinding operation is finished almost in a same cycle time.

DETAILED DESCRIPTION OF THE PREFERRED EMBODIMENT

Figure 1:
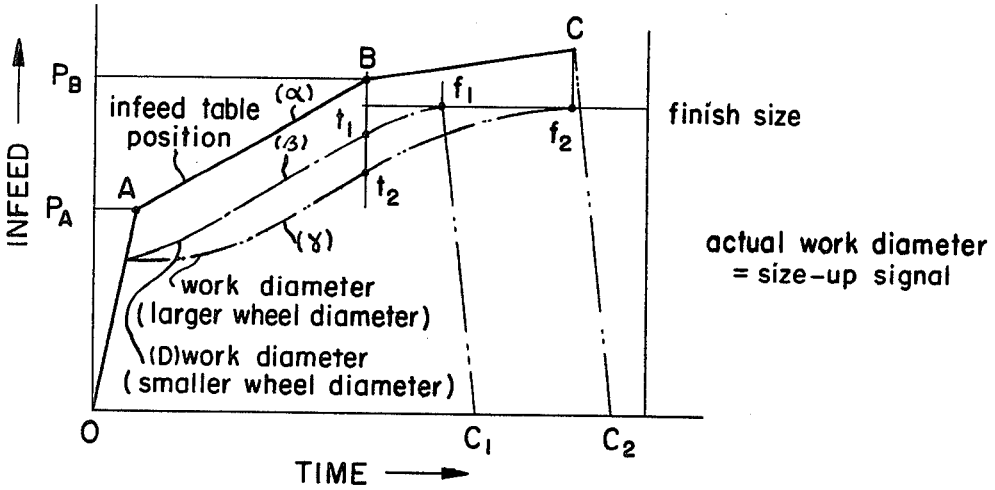
FIG. 1 PRIOR ART
FIG. 1 is a timing graph of a conventional constant programmed infeed internal grinding process.
Figure 3:
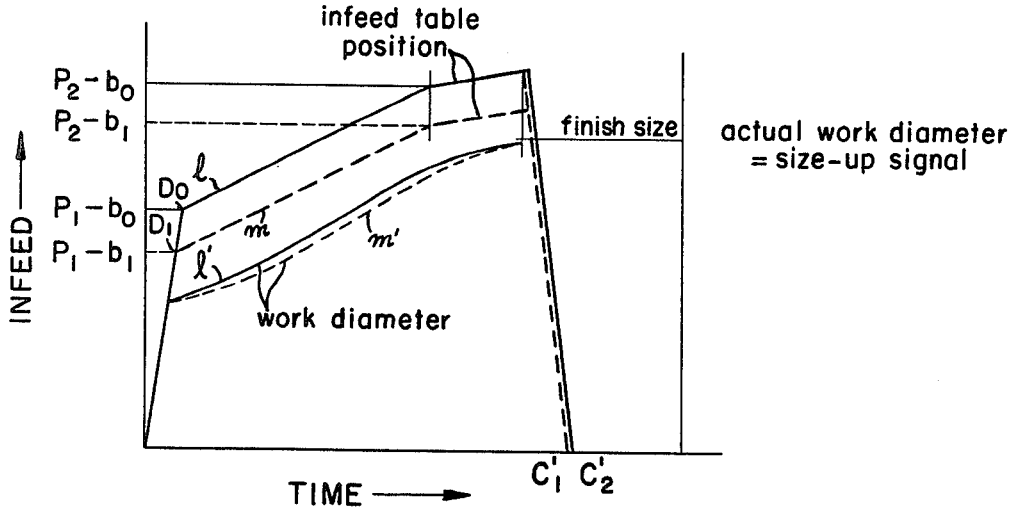
FIG. 3 is a timing graph representing an internal grinding process using the infeeding method of this invention.

Now, an embodiment of this invention applied on an internal grinder will be described referring to FIGS. 2 and 3.

Figure 2:
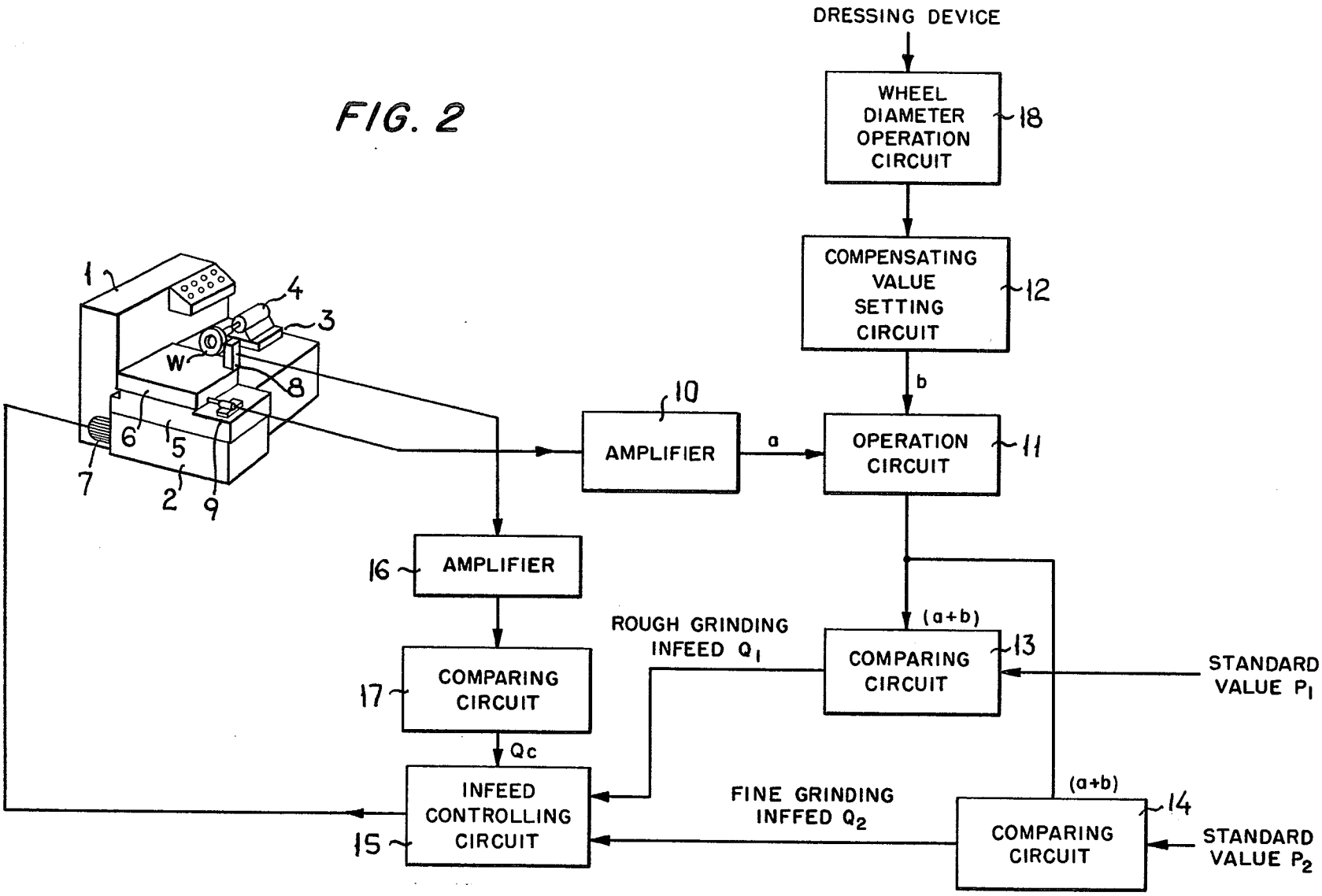
FIG. 2 is a block diagram showing an embodiment of the infeeding method according to this invention.

FIG. 2 is a block diagram showing an embodiment of the infeeding method of the invention, in which reference numeral 1 designates an internal grinder which is provided with a grinding wheel spindle device 4 mounted on a bed 2 by way of a slide table 3 and an infeeding table 6 mounted on bed 2 by way of a table stand 5. Infeeding table 6 is slidable in a perpendicular direction relative to the sliding direction of wheel spindle device 4 and is driven by an infeeding device 7 provided in bed 2.

A workpiece W is held in a work spindle device which is mounted on infeeding table 6 but is not shown in the drawing. Reference numeral 8 is an inprocess size measuring device mounted on infeeding table 6. This size measuring device 8 continuously measures the workpiece diameter while the workpiece is worked by the grinding wheel of the wheel spindle device 4. Reference numeral 9 designates a location or position detecting device mounted on table stand 5 to detect the location or position of infeeding table 6. The detected signal from location detecting device 9 is amplified by an amplifier 10 to be the location signal $a$ of infeeding table 6. This location signal $a$ and a compensating value $b$ set by a compensating value setting circuit 12 which will be described hereinafter are inputs of an operation circuit 11. The output sum $a + b$ is fed to a pair of comparing or comparator circuits 13 and 14. Comparing circuit 13 generates output $Q_1$ when the output $a + b$ of operation circuit 11 reaches at standard value $P_1$ (i.e. location signal $a$ reaches at a value of $P_1 - b$), while comparing circuit 14 generates output $Q_2$ when the output $a + b$ of operation circuit 11 reaches another standard value $P_2$ (i.e. location signal $a$ reaches $P_2 - b$).

The outputs $Q_1$ and $Q_2$ are fed to an infeed control circuit 15 which controls infeeding device 7, signal $Q_1$ being used as the changing signal to change from the rapid infeed speed to the rough grinding infeed speed and signal $Q_2$ being used as the changing signal to change from the rough grinding infeed speed to the fine grinding infeed speed.

Reference numeral 16 designates an amplifier to amplify the output of inprocess size measuring device 8 into a workpiece size signal, which is compared with a predetermined finish size value in a comparing circuit 17. This comparing circuit 17 generates output $Q_c$ and applies it to infeed control circuit 15 when the workpiece size signal reaches the finish size value, i.e. when the workpiece diameter reaches the finish size. This output signal $Q_c$ makes infeed control circuit 15 stop infeed and return infeeding table 6 to its initial position.

Said compensating value setting circuit 12 changes its output level of compensating value $b$ in response to the wheel diameter value fed from a wheel diameter operation circuit 18 which generates the wheel diameter with the initial diameter of the wheel and dressing amount. The dressing amount is attained from the dressing infeed of the dressing device. If the dressing depth for every dressing is constant, the wheel diameter can be computed with the dressing number.

The operation in the above-mentioned infeed method according to this invention will now be described hereinafter.

When the wheel diameter is initially $D_0$, the compensating value setting circuit 12 generates $b_0$ which is rather large and corresponds to the larger diameter $D_0$. In this state, infeed table 6 is rapid fed until the location signal $a$ of the infeed table reaches at $P_1 - b_0$, and then, the infeed table 6 is fed in at the rough grinding infeed speed until the signal $a$ reaches at $P_2 - b_0$ where infeed table 6 is thereafter fed in at the fine grinding infeed speed as shown by line $l$ in FIG. 3. With this infeed movement of infeed table 6, actual stock removal of the workpiece W is performed on a line as $l'$. When the workpiece diameter reaches the finish size, infeed table 6 returns quickly to $C_1'$.

When the wheel diameter has decreases to $D_1$ with dressing or other wear, the compensating value setting circuit 12 generates a smaller value $b_1$ corresponding to the smaller wheel diameter $D_1$. In this state, infeed table 6 is rapid fed till the location signal $a$ reaches at $P_1 - b_1$, and then, is changed to be fed with rough grinding infeed speed till the signal $a$ reaches at $P_2 - b_1$ where infeed table 6 is changed to be fed in at the fine grinding infeed speed as shown by dotted line $m$ in FIG. 3. With this infeed movement of infeed table 6, actual stock removal of the workpiece is performed on a line $m'$ which is near line $l'$. That is, in this case, the infeed speed changing points are shifted to occur before the changing points for the larger wheel case. Thus, infeed table 6 returns to $C_2'$ after finishing wheel diameter.

The smaller the wheel diameter becomes with higher its grinding ability, the earlier the changing points shift gradually, whereby, actual stock removal of the workpiece is performed with an almost constant rate and cycle time.

What is claimed is:

1. A method of operating an internal grinder having a grinding wheel, comprising:

rapidly infeeding the grinding wheel from a rest position to a grinding position;

operating the grinding wheel to effectuate grinding and simultaneously infeeding the grinding wheel at an infeeding speed slower than the speed of rapid infeeding;

returning the grinding wheel to the rest position after grinding is complete;

measuring a diameter of the grinding wheel;

rapidly infeeding the grinding wheel from the rest position to another grinding position before initiating a subsequent grinding operation; and controlling the rapid infeeding to another grinding position to terminate the rapid infeeding to another grinding position earlier than the first-mentioned step of rapidly infeeding the grinding wheel when a decrease in grinding wheel diameter is measured in order to compensate for increased grinding ability of the smaller diameter grinding wheel.

2. A method according to claim 1, wherein the step of operating the grinding wheel and simultaneously infeeding the grinding wheel comprises reducing the speed of infeeding after a predetermined amount of grinding has occurred, and wherein the step of reducing the speed of infeeding occurs earlier with subsequent grinding operations when a decrease in grinding wheel diameter is measured in order to compensate for increased grinding ability of the smaller diameter grinding wheel.

* * * * *